US006939174B2

(12) United States Patent
Wu

(10) Patent No.: US 6,939,174 B2
(45) Date of Patent: Sep. 6, 2005

(54) CABLE ASSEMBLY WITH INTERNAL CIRCUIT MODULES

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 61 days.

(21) Appl. No.: 10/612,029

(22) Filed: Jul. 1, 2003

(65) Prior Publication Data

US 2005/0003707 A1 Jan. 6, 2005

(51) Int. Cl.[7] ..... H01R 13/648
(52) U.S. Cl. ..... 439/608; 439/701
(58) Field of Search ..... 439/608, 607, 439/579, 610, 76.1, 108, 101

(56) References Cited

U.S. PATENT DOCUMENTS 5,924,899 A 7/1999 Paagman
5,934,941 A * 8/1999 Hirai et al. ..... 439/607
6,102,747 A 8/2000 Paagman
6,217,364 B1 4/2001 Miskin et al.
6,336,826 B1 * 1/2002 Kraft ..... 439/498
6,468,100 B1 * 10/2002 Meyer et al. ..... 439/320
6,752,633 B2 * 6/2004 Aizawa et al. ..... 439/63
6,757,177 B2 * 6/2004 Harris et al. ..... 361/788

* cited by examiner

*Primary Examiner*—Alexander Gilman
(74) *Attorney, Agent, or Firm*—Wei Te Chung

(57) ABSTRACT

A cable assembly (1) for engaging a complementary connector includes an insulating housing (10), a number of first and second circuit modules (20) received in the housing, and a two-piece cover (30) cooperating with the housing for retaining the circuit modules. Each circuit module includes a circuit board (22*a*, 22*b*) accommodated in the housing. Each first circuit module includes a number of first coaxial cables (23*a*) for transmitting single-ended signals and each second circuit module includes a number of second cables (23*b*) for transmitting differential pairs of signals. The first and the second circuit modules are staggeredly arranged with each other.

17 Claims, 13 Drawing Sheets

CABLE ASSEMBLY WITH INTERNAL CIRCUIT MODULES

CROSS-REFERENCE TO RELATED APPLICATIONS

Subject matter of this patent application is related to pending U.S. patent application Ser. No. 10/316,547, filed on Dec. 10, 2002 and entitled "CABLE ASSEMBLY"; Ser. No. 10/278,520, filed on Oct. 22, 2002 and entitled "ELECTRICAL CABLE CONNECTOR"; about to be filed and entitled "CABLE ASSEMBLY WITH IMPROVED GROUNDING MEANS"; and an Ser. No. 10/607,421, filed on Jun. 25, 2003 and entitled "CABLE ASSEMBLY WITH INTERNAL CIRCUIT MODULES", all of which are invented by Jerry Wu and assigned to the same assignee as this application.

BACKGROUND OF THE INVENTION

1. Field of the Invention

The present invention generally relates to a cable assembly, and particularly to a cable assembly having a plurality of circuit boards for high speed signal transmission.

2. Description of Related Art

With the development of communication and computer technology, high density electrical connectors are desired to construct a plurality of signal transmitting paths between two electronic devices. Each of these electrical connectors provides a plurality of circuit boards to thereby achieve improved signal transmission of different electrical characteristics through the connector. Such high density electrical connectors, such as cable assemblies, are widely used in internal connecting systems of severs, routers and the like requiring high speed data processing and communication.

U.S. Pat. No. 6,217,364, issued to Miskin et al., discloses a cable assembly including an insulating housing formed by a pair of substantially identical housing halves and an electrical cable with a plurality of wires terminated to conductive terminals overmolded in a plurality of thin flat wafers. The housing halves combine to define an interior cavity having a front opening and a rear opening. The wafers are closely juxtaposed in a parallel array and are positioned within the interior cavity of one of the housing halves such that the cable projects out of the rear opening of the cavity. The other housing half is then to completely enclose the cable and wafer subassembly. However, the cable and wafer subassembly are retained in the housing by securing the housing halves together through bolts and nuts, thereby complicating the assemblage of the cable assembly. Furthermore, an engagement of the housing halves is easy to become loose due to vibration during the transportation and other matters, whereby the cable and the wafer subassembly cannot be stably retained in the housing. Thus, an electrical connection is adversely affected between the cable assembly and a complementary connector.

U.S. Pat. No. 5,924,899 (the '899 patent) and U.S. Pat. No. 6,102,747 (the '747 patent), both issued to Paagman, each disclose a cable assembly. Referring to FIGS. 4*a*–4*c* and 5*a*–5*c* of the '899/'747 patent, the cable assembly includes an insulating housing with a plurality of parallel slots defined therein and a plurality of modules received in the slots of the housing. Each module includes a circuit substrate, a receptacle carrier having a plurality of fork contacts at one end of the substrate and an insulation displacement contact (IDC) carrier at the other end of the substrate opposite the terminal carrier. The insulation displacement carrier has insulation displacement contacts connecting with conductors of corresponding cables. The modules each are retained in the housing through an interference fit with the housing. When the cable assembly is required to disengage from a complementary connector, a pulling force is exerted on an exposed end of the cable for releasing the engagement between the cable assembly and the complementary connector. However, the modules may be pulled back with regard to the housing, thereby adversely affecting an electrical engagement when the cable assembly mates with the complementary connector again. Furthermore, an additional device is employed to bond the cables together, thereby increasing the cost of the production.

Hence, an improved cable assembly is highly desired to overcome the disadvantages of the related art.

BRIEF SUMMARY OF THE INVENTION

Accordingly, it is an object of the present invention to provide a cable assembly having strain relief means for substantially resisting a pulling force exerted on a cable thereof.

It is another object of the present invention to provide a cable assembly having both single-ended signal modules and differential signal modules.

In order to achieve the above-mentioned objects, a cable assembly in accordance with the present invention for engaging a complementary connector comprises an insulating housing, a plurality of first and second circuit modules received in the housing, and a two-piece cover cooperating with the housing for retaining the circuit modules. Each circuit module includes a circuit board accommodated in the housing. Each first circuit module includes a plurality of first coaxial cables for transmitting single-ended signals and each second circuit module includes a plurality of second cables for transmitting differential pairs of signals. The first and the second circuit modules are staggeredly arranged with each other.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
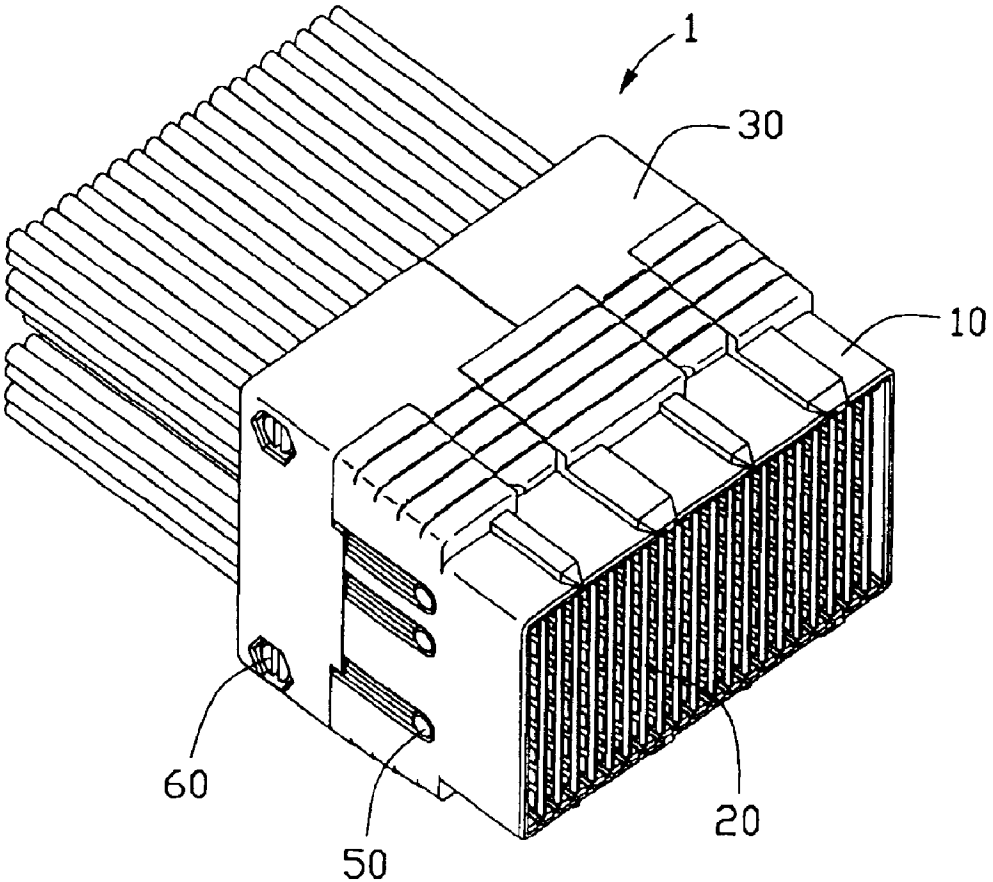
FIG. 1 is a perspective view of a cable assembly in accordance with the present invention.

Reference will now be made to the drawing figures to describe the present invention in detail.

Figure 2:
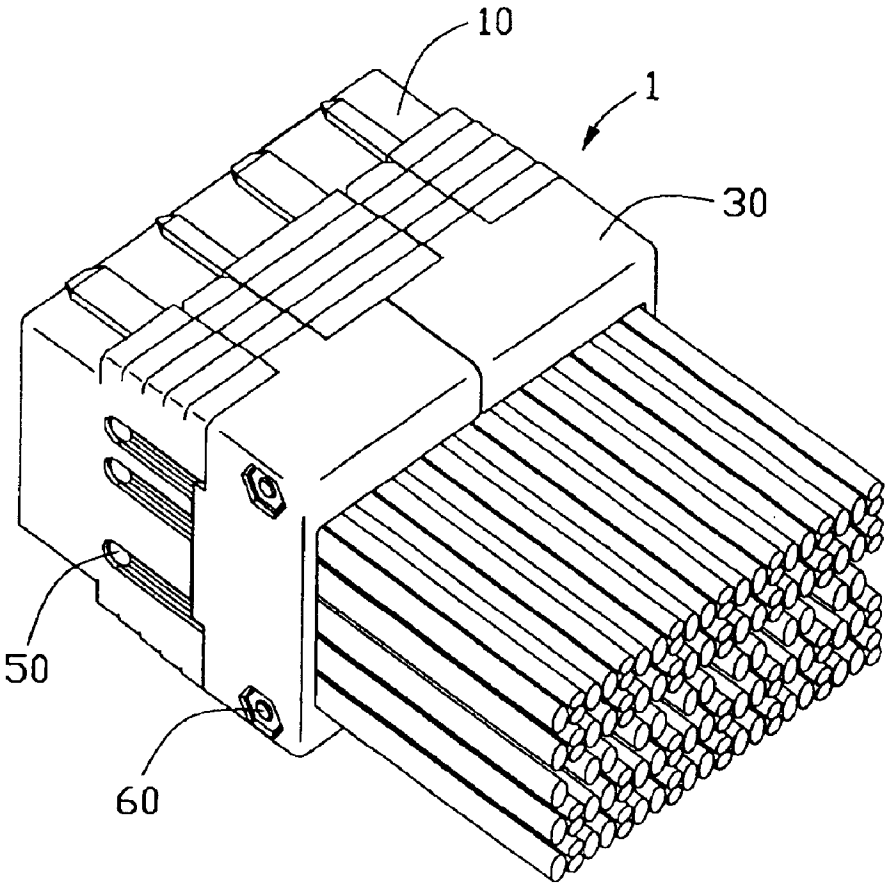
FIG. 2 is another perspective view of the cable assembly.

With reference to FIGS. 1 and 2, a cable assembly 1 in accordance with the present invention comprises a front insulating housing 10, a plurality of circuit modules 20 received in the front insulating housing 10, and a two-piece rear cover 30 together with the front insulating housing 10 for retaining the circuit modules 20.

Figure 3:
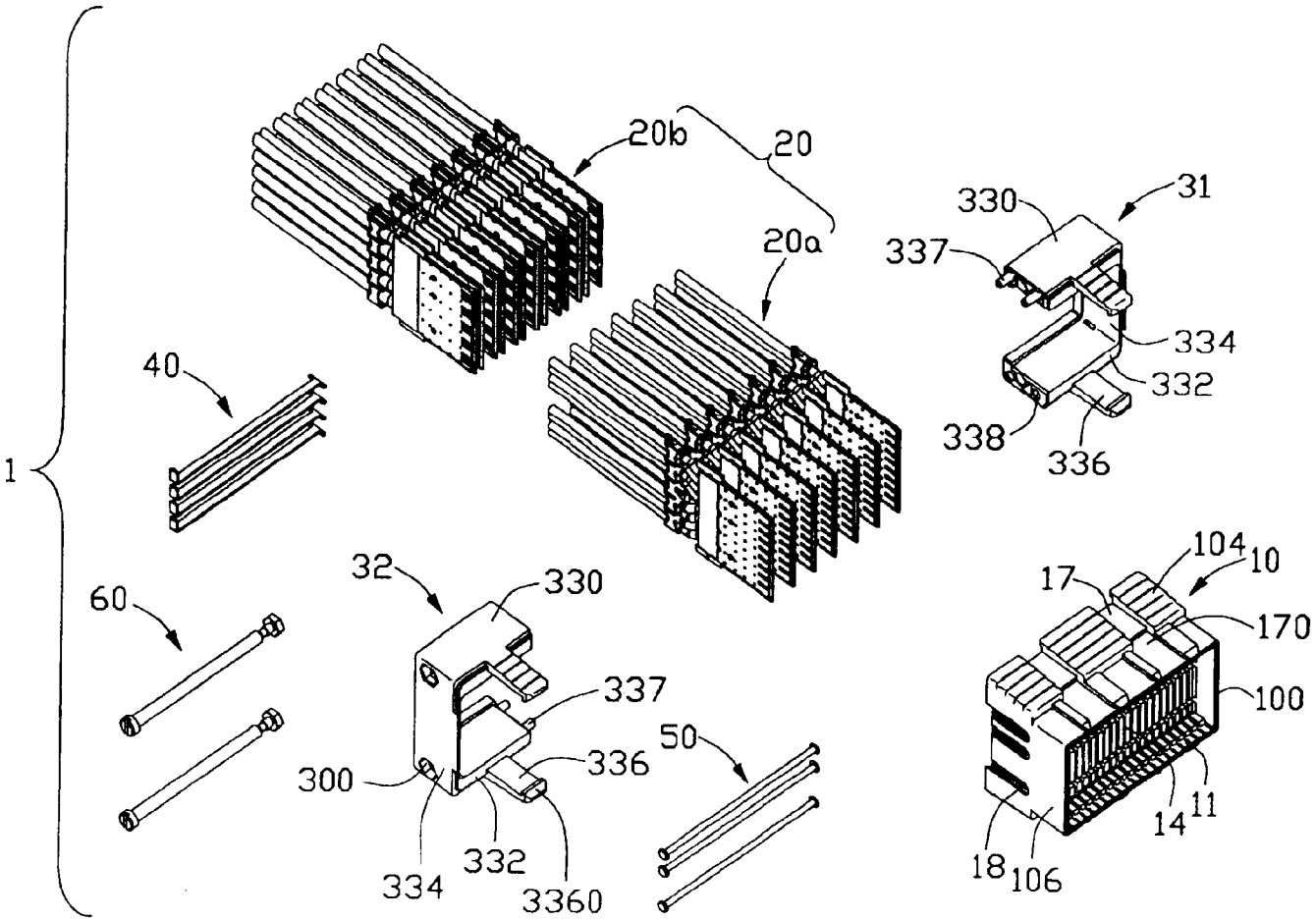
FIG. 3 is an exploded, perspective view of the cable assembly shown in FIG. 1.
Figure 4:
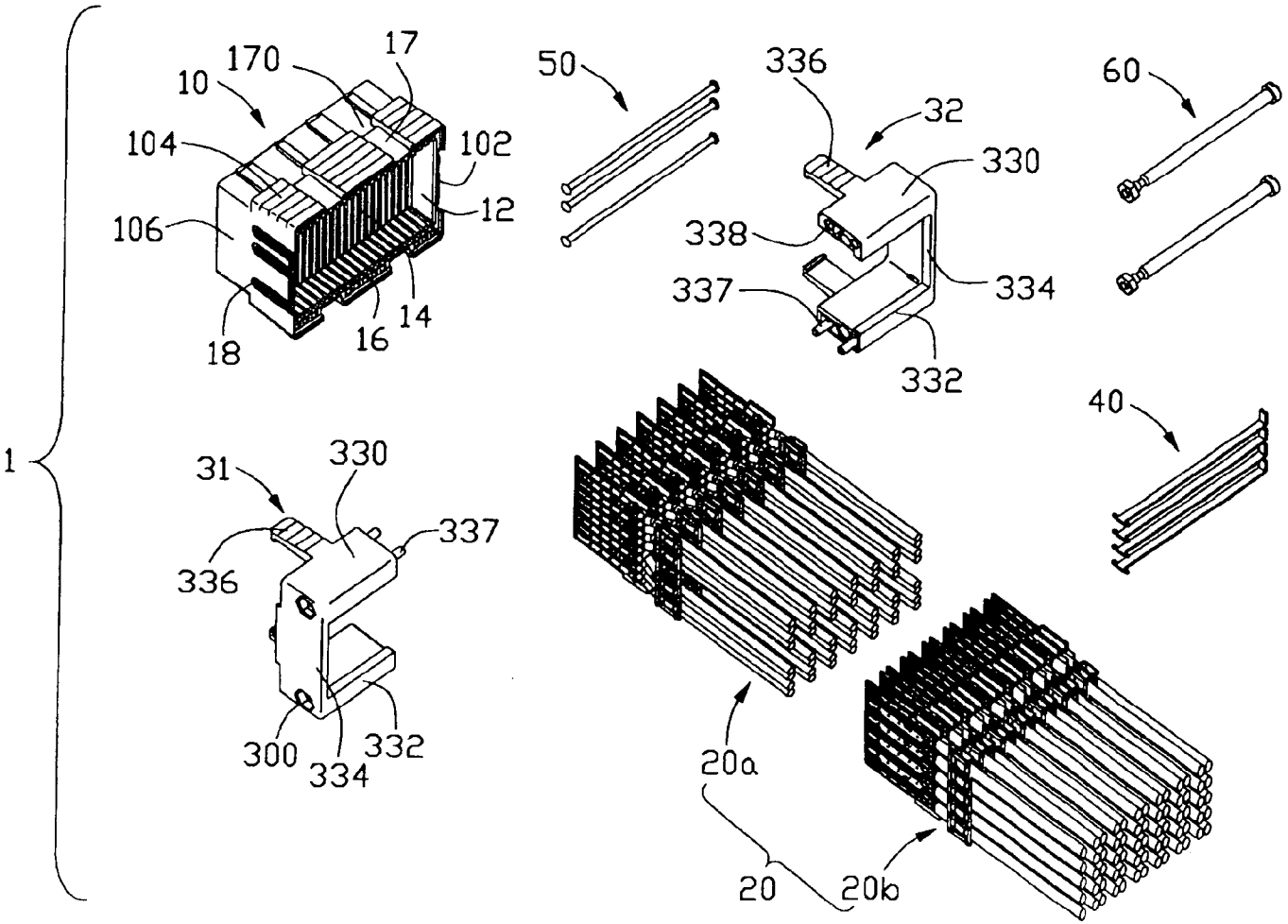
FIG. 4 is an exploded, perspective view of the cable assembly shown in FIG. 2.
Figure 5:
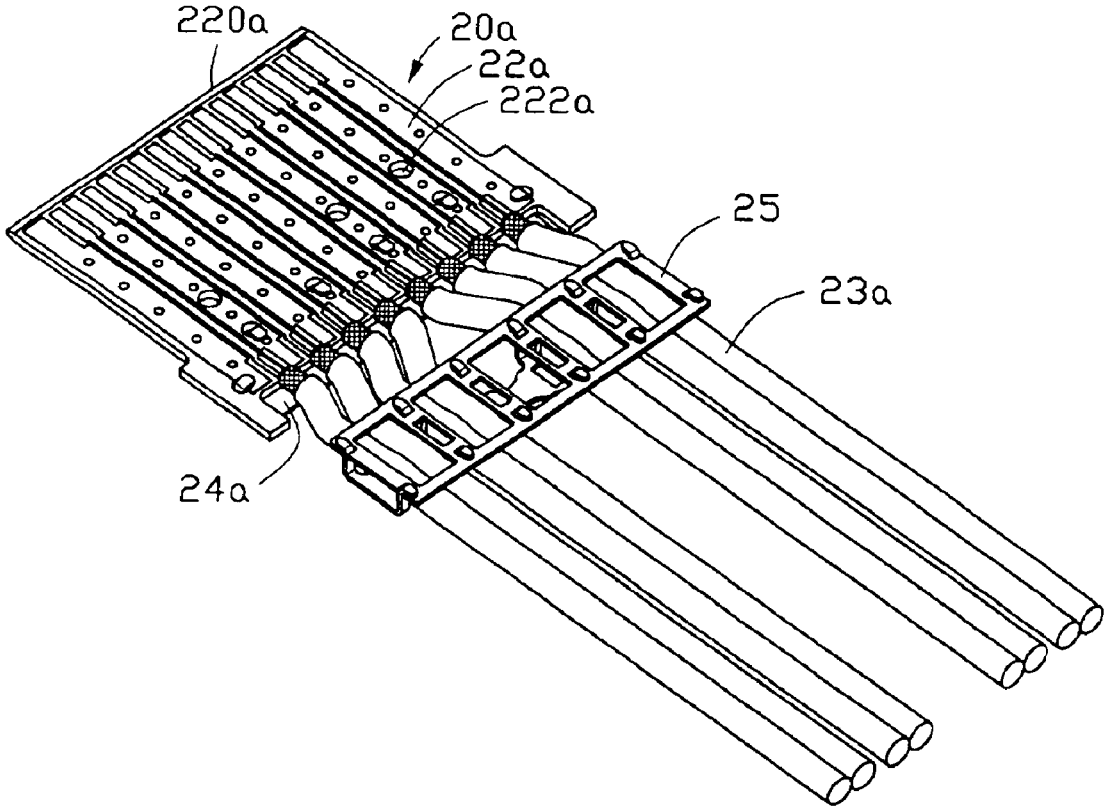
FIG. 5 is a perspective view of a first circuit module.
Figure 6:
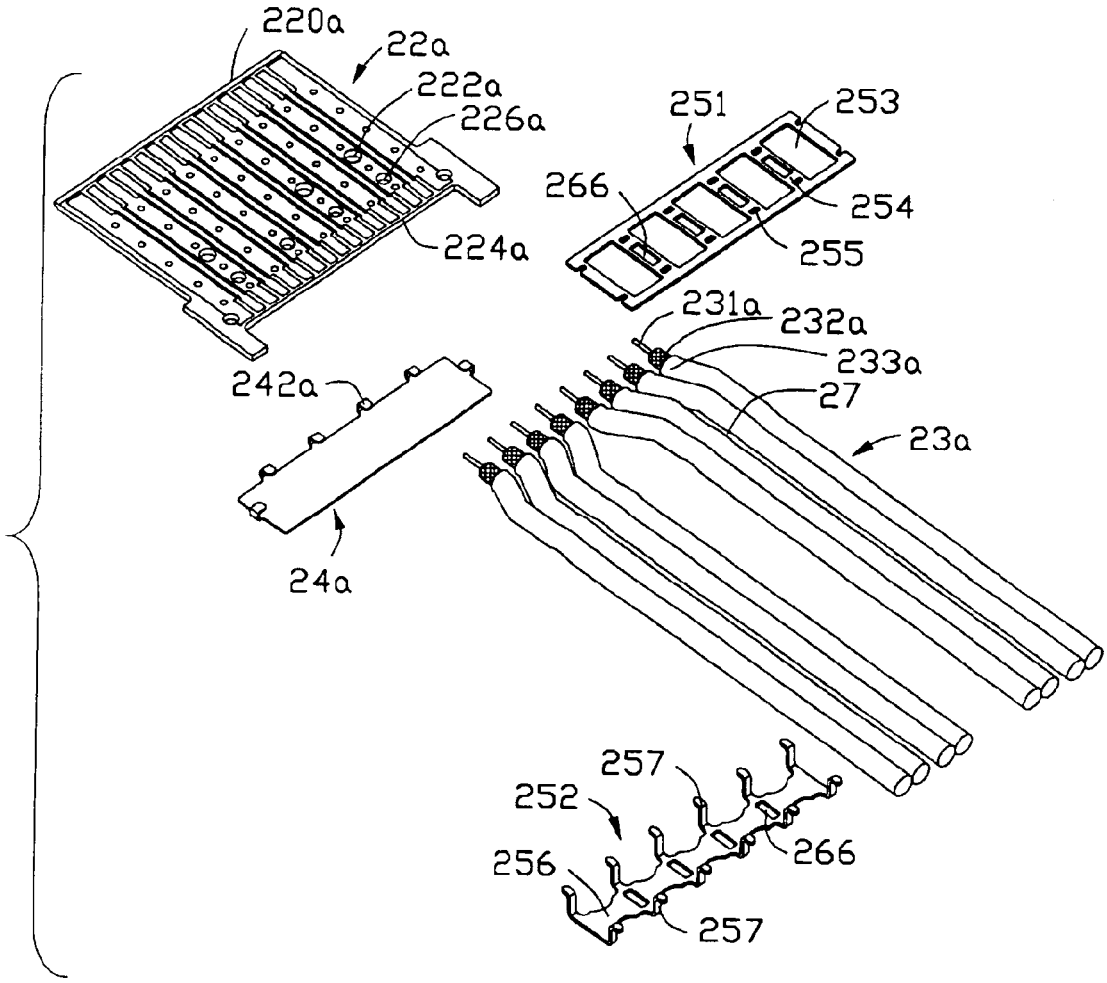
FIG. 6 is an exploded, perspective view of the first circuit module shown in FIG. 5.
Figure 7:
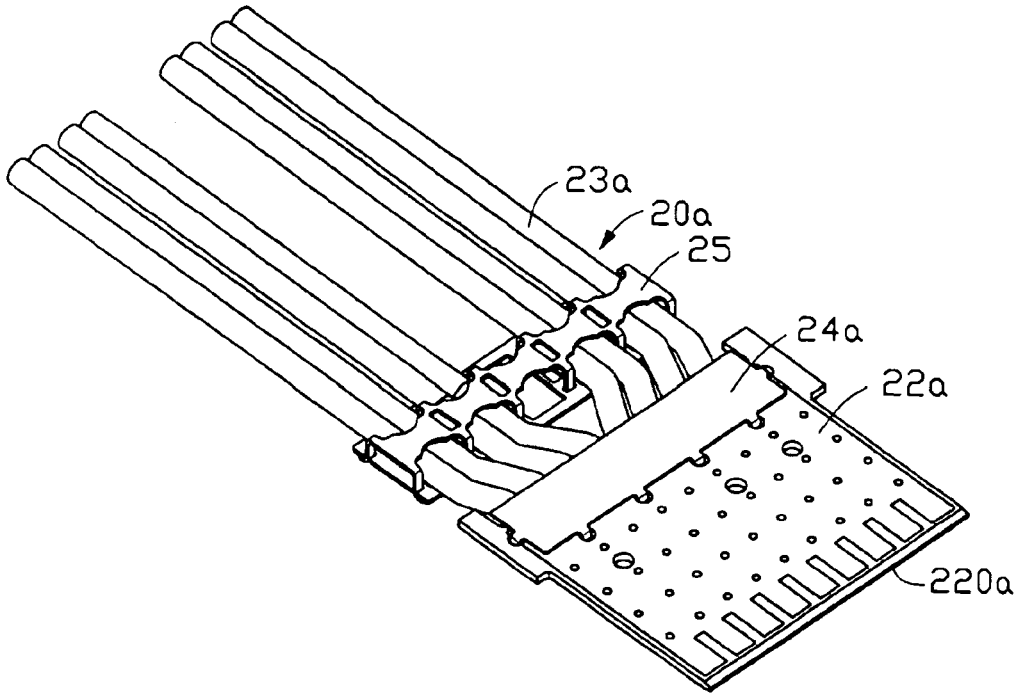
FIG. 7 is another perspective view of the first circuit module.
Figure 8:
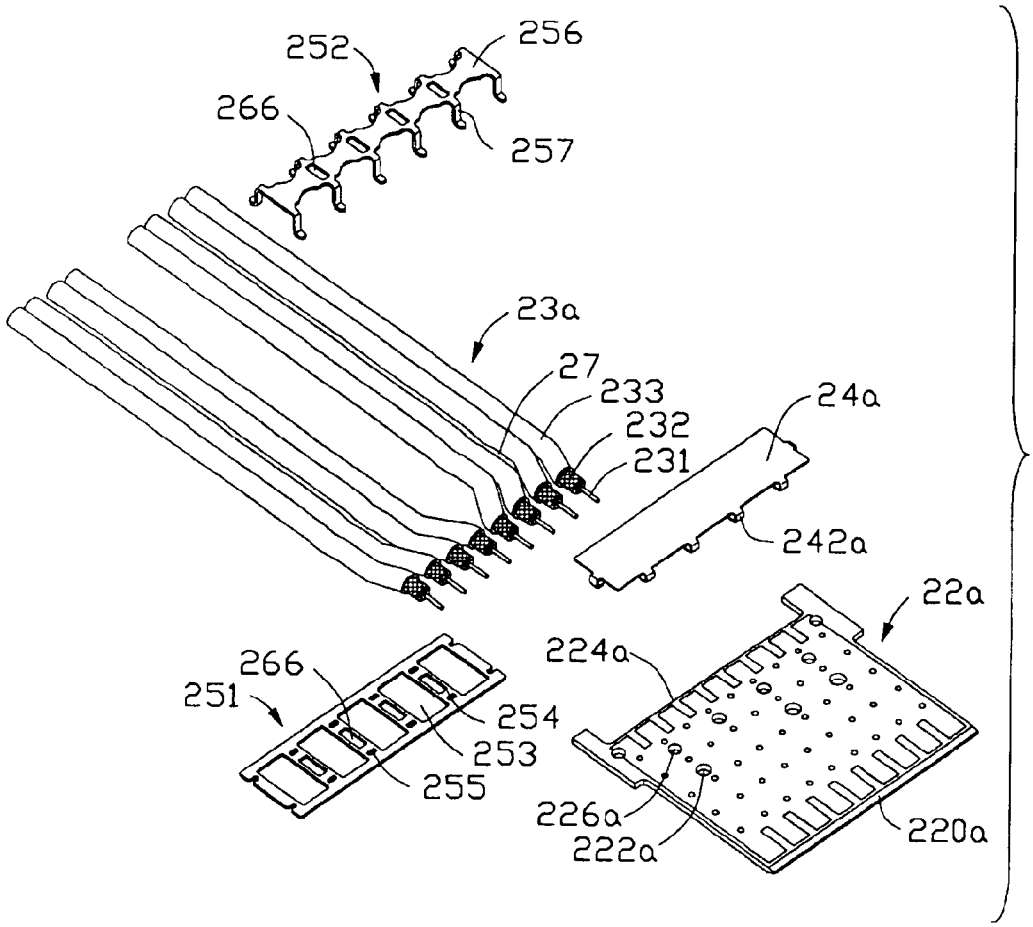
FIG. 8 is an exploded, perspective view of the first circuit module shown in FIG. 7.
Figure 9:
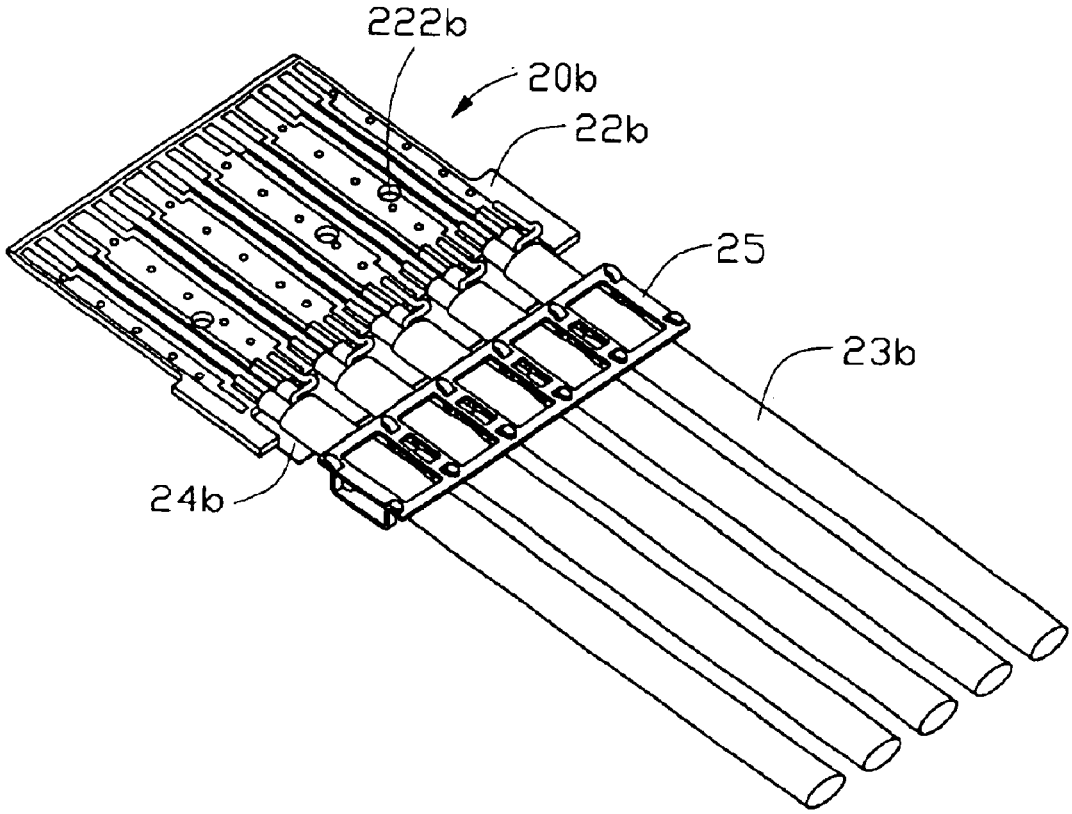
FIG. 9 is a perspective view of a second circuit module.
Figure 10:
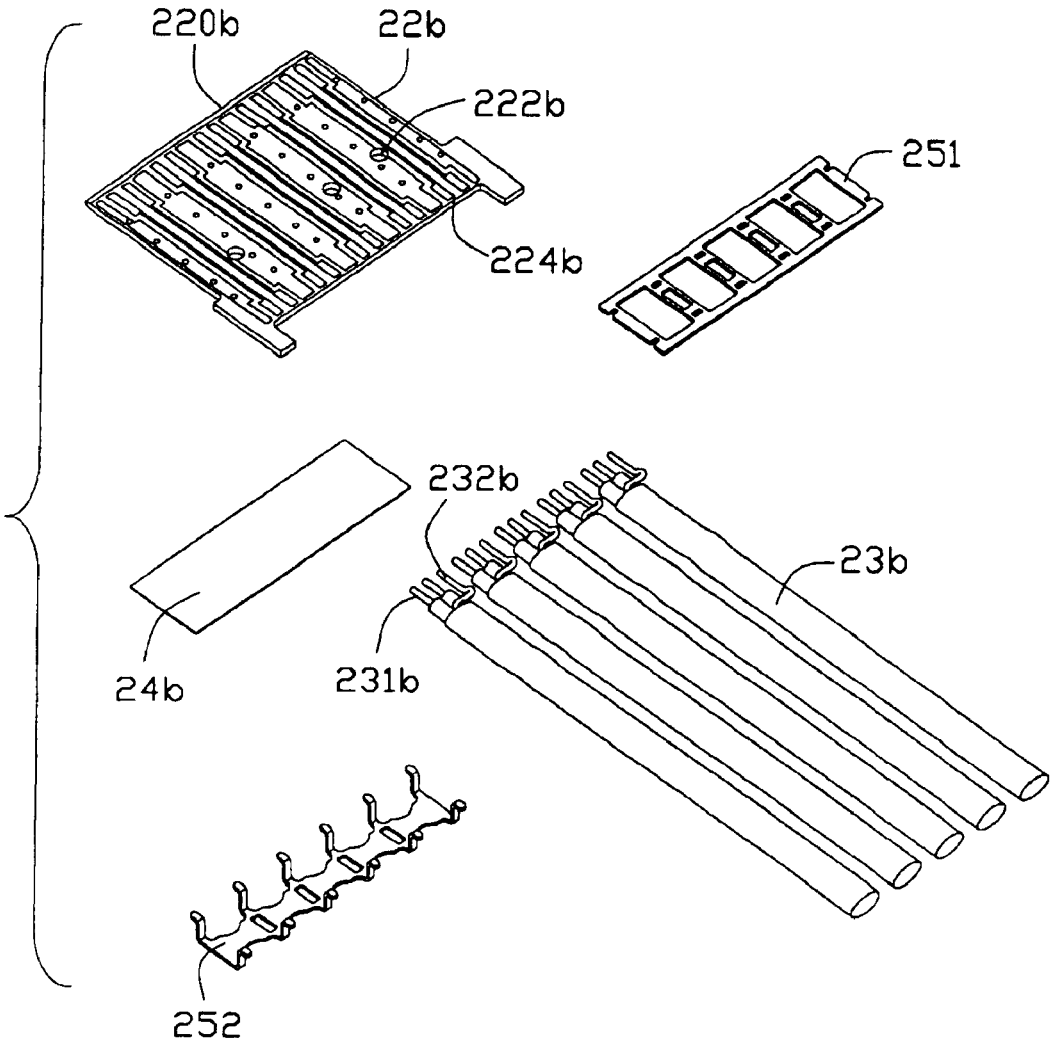
FIG. 10 is an exploded, perspective view of the second circuit module shown in FIG. 9.
Figure 11:
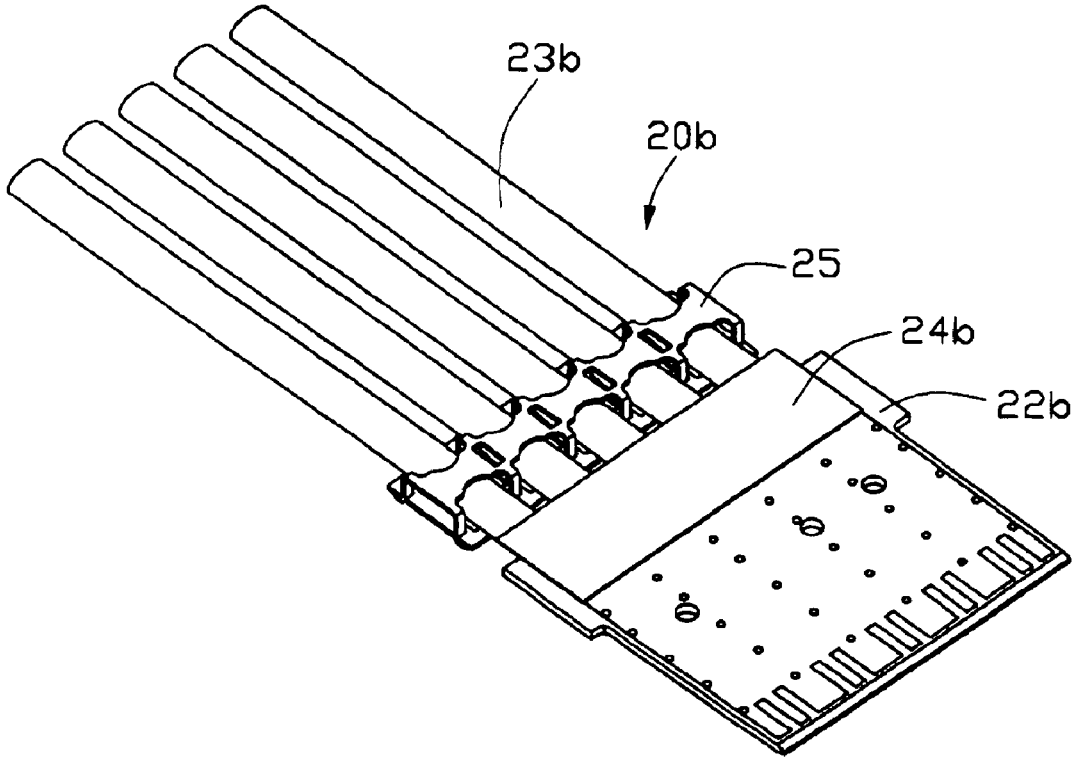
FIG. 11 is another perspective view of the second circuit module.
Figure 12:
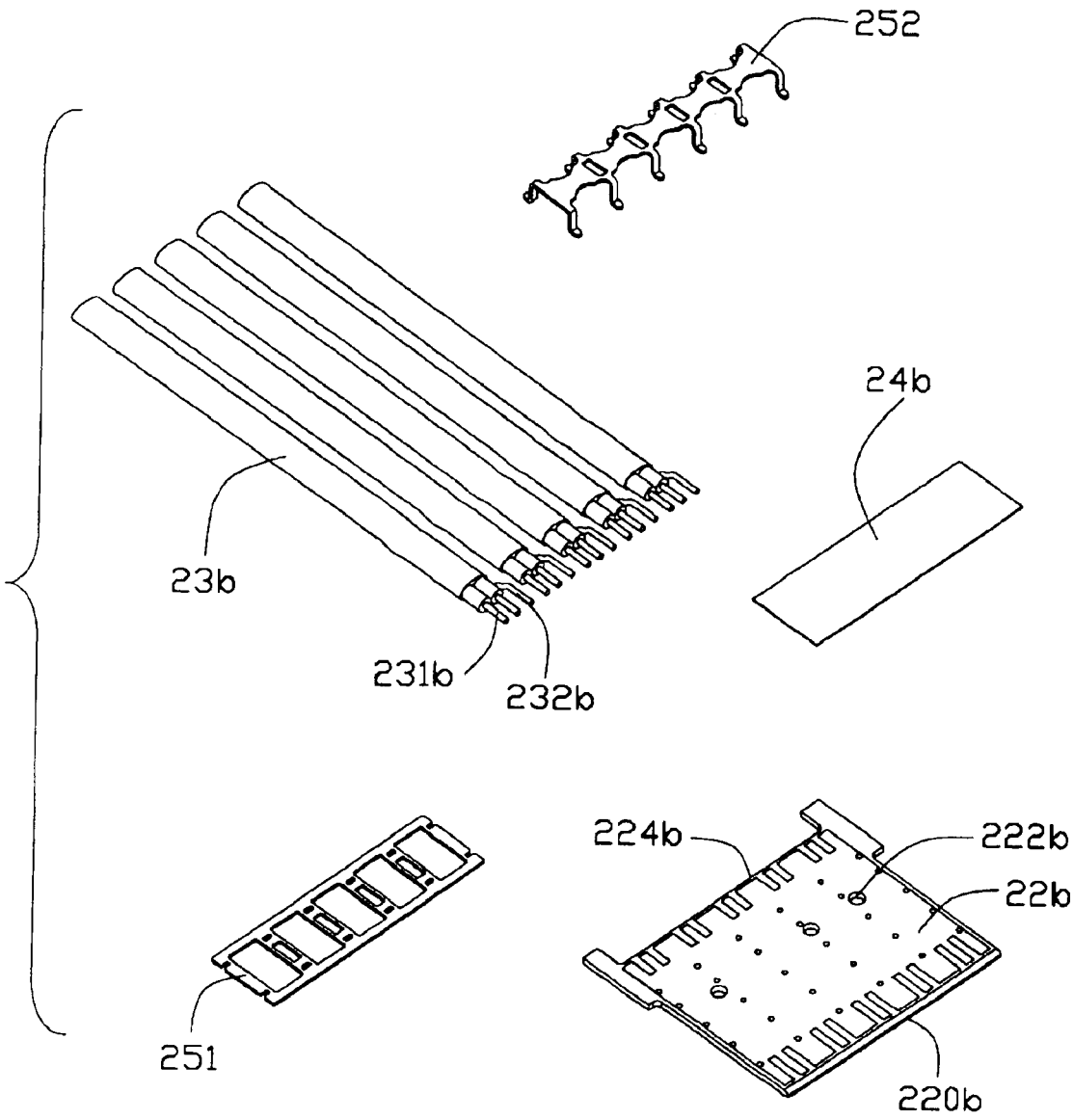
FIG. 12 is an exploded, perspective view of the second circuit module shown in FIG. 11.

Referring to FIGS. 3 and 4, the front housing 10 is generally in a rectangular shape. The housing 10 has a front mating port 11 in a front mating face 100 which faces a complementary connector (not shown) and a rear chamber 12 in a rear face 102. The housing 10 defines a plurality of parallel channels 14 extending in a front-to-back direction communicating with the front mating port 11 and the rear chamber 12 and a plurality of grooves 16 which are aligned with the channels 14. The housing 10 further defines a plurality of recesses 17 respectively in a top face 104 and a bottom face (not labeled) and a plurality of depressions 170 recessed downwardly from the corresponding recesses 17. An aperture 18 is defined through opposite side faces 106 of the housing 10 in a direction substantially perpendicular to the extending direction of the channels 14.

Continuing to FIGS. 3 and 4, the rear cover 30 comprises a split body having a first half 31 and a second half 32. Each half 31, 32 has a top panel 330, a bottom panel 332 and a side panel 334 formed between the top panel 330 and the bottom panel 332. Each half 31, 32 forms a pair of latches 336 extending forwardly from front edges of the top and bottom panels 330, 332, a plurality of dowel pins 337 and corresponding holes 338 for joining the first half 31 and the second half 32 together. Each latch 336 has a projection 3360 formed at a free end thereof. The rear cover 30 defines a bore 300 extending through the side panels 334 thereof. It should be noted that any other suitable connecting means may be employed to connect the first and second halves 31, 32. This split design helps to facilitate the assembly and installation of the cover 30 onto the housing 10 over the circuit modules 20. Understandably, the first and the second halves 31, 32 can be integrally formed with each other before assembling to the housing 10, if desired.

The circuit modules 20 comprise a plurality of first circuit modules 20*a* and a plurality of second circuit modules 20*b*, which are identical with each other in structure thereof, respectively. An exemplary one of the first circuit modules 20*a* is shown in FIGS. 5–8. Each first circuit module 20*a* comprises a circuit board 22*a* and a plurality of single-ended coaxial cables 23*a* electrically and mechanically connecting with the circuit board 22*a*. The circuit board 22*a* includes a dielectric substrate made of conventional circuit board substrate material, a plurality of conductive signal traces (not labeled) on one side of the substrate for providing electrical paths through the cable assembly 1 and a plurality of grounding traces (not labeled) on both sides of the substrate for grounding purpose. Each circuit board 22*a* comprises a front edge portion 220*a* provided for engaging with the complementary mating connector and a rear edge portion 224*a* to which the cables 23*a* are mechanically connected. A through hole 222*a* is provided on the circuit board 22*a* which aligns with the aperture 18 of the housing 10 and a plurality of cavities 226*a* are defined adjacent to the rear edge portion 224*a*.

The single-ended coaxial cables 23*a* of each first circuit module 20*a* are arranged in a common plane. As well known, each single-ended coaxial cable 23*a* comprises a conductive core 231*a* surrounded by a dielectric shield (not labeled), a metal braid 232*a* outside the dielectric shield, and a jacket 233*a* at the outmost side of the cable 23*a*. At a distal end of each coaxial cable 23*a*, a length of dielectric shield is stripped to expose a corresponding length of conductive core 231*a*. The bare conductive core 231*a* is soldered to the signal trace on the circuit board 22*a* from one side thereof. As can be best seen in FIGS. 6 and 8, in the preferred embodiment, the cables 23*a* of each first circuit module 20*a* are separated into two groups, each group comprising two pairs of coaxial cables 23*a* with a gap 27 being defined therebetween.

The first circuit module 20*a* also comprises a first grounding plate 24*a* and a cable clamp 25 adapted for being applied to the cables 23*a*. The first grounding plate 24*a* is preferably a copper tape and is formed with a plurality of tabs 242*a* positioned at a periphery thereof. The first grounding plate 24*a* is attached to the circuit board 22*a* from a side opposite to the conductive cores 231*a* of the cables 23*a* with the tabs 242*a* being retained in the cavities 226*a* of the circuit board 22*a* to thereby secure the first grounding plate 24*a* thereon. The end of each coaxial cable 23*a* is stripped to further expose a length of braid 232*a*, the exposed braid 232*a* being soldered to the first grounding plate 24*a* for grounding purpose.

The cable clamp 25 includes a first section 251 and a second section 252 both are stamped and formed from metal tapes. The first section 251 defines a plurality of rooms 253 and forms a plurality of bridges 254 between adjacent rooms 253. Each bridge 254 defines a pair of openings 255 at opposite ends thereof. The second section 252 includes a body portion 256 and two rows of tails 257 upwardly extending from two opposite sides of the body portion 256. The first and second sections 251, 252 clamp ends of the cables 23*a* from opposite sides with the tails 257 of the second section 252 being locked in corresponding openings 255 of the first section 251. The ends of the cables 23*a* are depressed by the body portion 256 of the second section 252 such that they are partially pressed into corresponding rooms 253 of the first section 251. The first and second sections 251, 252 further define a plurality of through holes 266 which are aligned with corresponding gaps 27 between adjacent pairs of cables 23*a* of a same group.

It should be noted here that an end of each coaxial cable 23*a* is stripped to further expose a length of braid 232*a*, the exposed braid 232*a* being soldered to the first grounding plate 24*a* attached on an opposite side of the circuit board 22*a* to provide not only a grounding function but a strain relief function for the cable 23*a*.

Similarly, an exemplary one of the second circuit modules 20*b* is shown in FIGS. 9–12. Each second circuit module 20*b* comprises a circuit board 22*b* and a plurality of cables 23*b* electrically and mechanically connecting with the circuit board 22*b*. The circuit board 22*b* includes a dielectric substrate, a plurality of conductive signal traces (not labeled) on one side of the substrate for providing electrical paths through the cable assembly 1 and a plurality of grounding traces (not labeled) on both sides of the substrate for grounding purpose. The arrangement of the traces printed on the circuit board 22*b* of the second circuit module 20*b* is different from that of the first circuit module 20*a* because the first circuit module 20*a* is structured for transmitting single-ended signals while the second circuit module 20*b* is structured for transmitting differential pairs of signals. Each circuit board 22*b* comprises a front edge portion 220*b* provided for engaging with the complementary mating connector and a rear edge portion 224*b* to which the cables 23*b* are mechanically connected. A through whole 222*b* is provided on the circuit board 22*b* which aligns with the aperture 18 of the housing 10 and the through hole 222*a* of the first circuit module 20*a*.

Each cable 23*b* of the second circuit module 20*b* comprises a pair of differential wires 231*b* soldered to the signal traces on the circuit board 22*b* and a grounding wire 232*b* soldered to the ground traces. The second circuit module 20*b* also comprises a second, planar grounding plate 24*b* attached to a side of the circuit board 22*b* opposite to the cables 23*b* soldered on the other side. The second circuit module 20*b* further includes a cable clamp 25. The cable clamp 25 of the second circuit module 20*b* is substantially same to that of the first circuit module 20*a* and will not be described here again.

In assembly, the circuit modules 20 are inserted into the channels 14 of the housing 10 from the rear face 102 with the circuit boards 22*a*, 22*b* being substantially retained in the grooves 16. First fastening elements 40 are inserted into the through-holes 266 of the cable clamps 25 for locking the circuit modules 20 together for strain relief purpose. A second fastening element 50 is inserted into holes 222*a*, 222*b* defined in the circuit boards 22*a*, 22*b* through the aperture 18 of the housing 10. The second fastening element 50 is further fastened to the housing 10 for keeping the circuit modules 20 in their original positions rather than be pushed back when the cable assembly 1 mates with the complementary connector, thereby stably retaining the circuit modules 20 in the housing 10.

The first and second halves 31, 32 of the cover 30 are assembled to the housing 10 with the projections 3360 of the latches 336 mechanically engage the depressions 170 of the recesses 17. At the same time, the first and second halves 31, 32 are connected by an interference engagement between the dowel pins 337 and the corresponding recesses 338. A third fastening element 60 is inserted into the bore 300 of the cover 30 for retaining the circuit modules 20 in the cover 30.

It is noted that since the circuit modules 20 are stably retained by the front housing 10 and the rear cover 30 via the second and third fastening elements 50, 60, a reliable electrical engagement is ensured between the cable assembly 1 and the complementary connector. It is also noted that the cables 23 are clamped by the cable clamps 25, more importantly, the cable clamps 25 are locked together via the first fastening element 40, whereby a pulling force exerted on the cables 23 can be substantially released.

Figure 13:
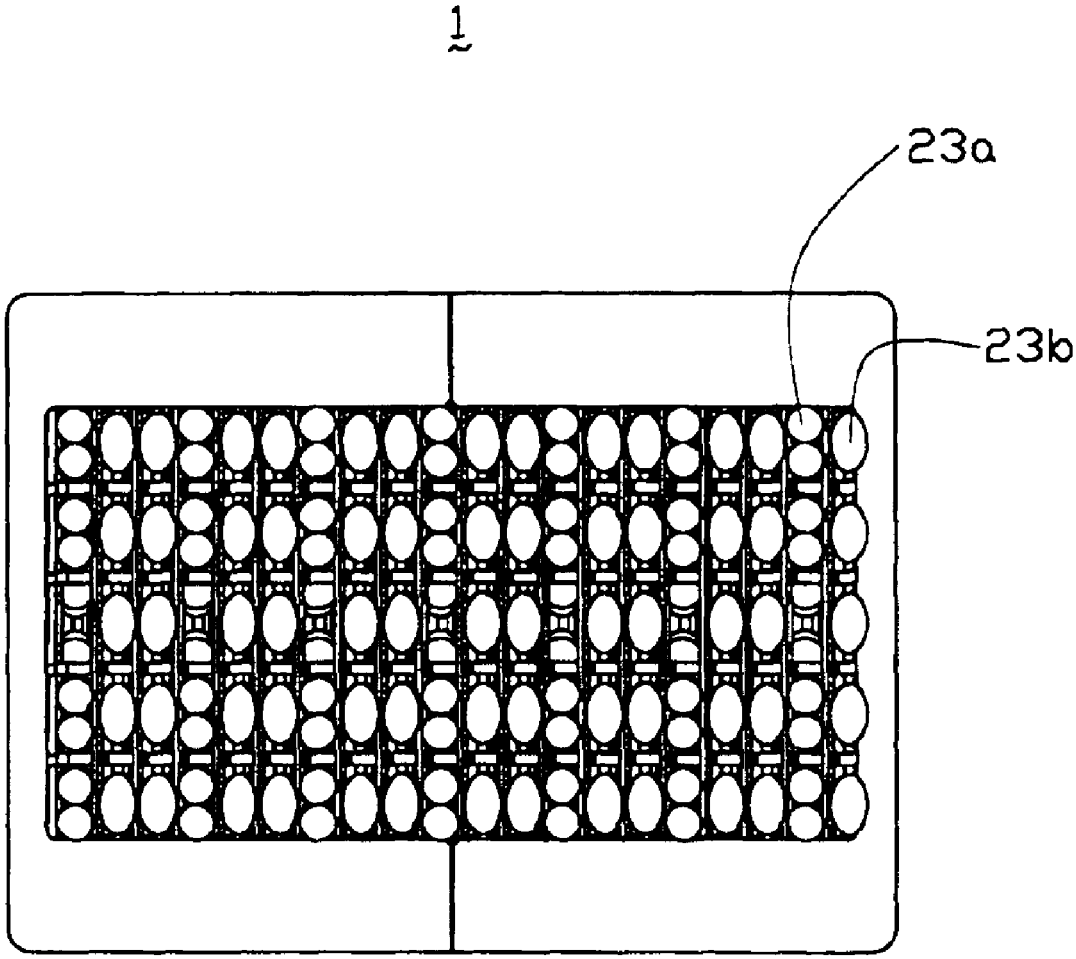
FIG. 13 is a rear plan view of the cable assembly.

Particularly referring to FIG. 13, a rear plan view of the cable assembly is shown. The first circuit modules 20*a* and the second circuit modules 20*b* are staggeredly arranged. In the preferred embodiment, each pair of second circuit modules 20*b* are sandwiched between two first circuit modules 20*a*, and one second circuit module 20*b* is positioned at the rightmost side of the cable assembly 1. Obviously, the arrangement of the first and second circuit modules 20*a*, 20*b* is changeable in order to meet different requirements conducted by different users.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable assembly comprising:

an insulating housing defining a plurality of channels; and a plurality of first and second circuit modules juxtaposed staggeredly in the housing, each first circuit module comprising a first circuit board received in a corresponding channel of the housing and a plurality of first cables connecting to the first circuit board, each second circuit module comprising a second circuit board received in a corresponding channel of the housing and a plurality of second cables connecting to the second circuit board;

wherein the first circuit module comprises a cable clamp bonding the first cables and a first grounding plate having a plurality of tabs and wherein the first circuit board defines a plurality of through holes receiving the plurality of tabs.

2. The cable assembly as described in claim 1, wherein each first cable is a single-ended coaxial cable comprising an insulated conductive core, a metal braid surrounding the insulated conductive core, and a jacket outside the metal braid, and wherein each second cable comprises a differential pair of wires and a grounding wire.

3. The cable assembly as described in claim 2, wherein the first grounding plate is soldered with the metal braids of the first cables.

4. The cable assembly as described in claim 2, wherein the second circuit module comprises a cable clamp bonding the second cables and a second planar grounding plate.

5. The cable assembly as described in claim 2, wherein each cable clamp comprises a first and a second stamped metallic sections clamping the first cables from opposite sides.

6. The cable assembly as described in claim 5, wherein the first section of the cable clamp defines a plurality of rooms and the first cables are depressed into the rooms by the second section.

7. The cable assembly as described in claim 6, further comprising a fastening means, and wherein each cable clamp defines at least one through hole aligned with each other for insertion of the fastening means.

8. A cable assembly comprising:

an insulating housing comprising a plurality of channels and an aperture extending along a direction perpendicular to the channels;

a plurality of first and second circuit modules staggeredly arranged in the housing, each module comprising a circuit board retained in a corresponding channel of the housing and defining therethrough a hole aligned with the aperture of the housing, each first circuit module comprising a plurality of first cables electrically connecting to one side of the circuit board and a first grounding plate attached to an opposite side of the circuit board, each second circuit module comprising a plurality of second cables electrically connecting to one side of the circuit board and a second grounding plate attached to an opposite side of the circuit board;

a cover comprising first and second halves jointed together and attached to the housing, the cover defining a bore extending through the first and second halves; and first and second fastening elements respectively inserted into the holes of the circuit boards through the aperture of the housing and into the bore of the cover for retaining the circuit modules in position;

wherein each circuit board of the first circuit modules defines a plurality of cavities and the first grounding plate has a plurality of tabs extending from a periphery thereof and retained in corresponding cavities of the circuit board.

9. The cable assembly as described in claim 8, wherein two adjacent second circuit modules ore sandwiched between two first circuit modules.

10. The cable assembly as described in claim 8, wherein the first cables are coaxial cables for transmitting single-ended signals, and wherein the second cables are for transmitting differential pairs of signals.

11. The cable assembly as described in claim 8, wherein each circuit module further comprises a cable clamp bonding the cables together, the cable clamp defining a through hole.

12. The cable assembly as described in claim 11, further comprising a third fastening element inserted into the through holes of the cable clamps.

13. A cable assembly comprising:

an insulative housing defining a plurality of channels;

a plurality of juxtaposed first and second printed circuit boards having a similar dimension with each other and mixed up and alternately, in a predetermined format, arranged with each other, at a same level, with front edge regions received in the corresponding channels, respectively; and a plurality of first and second sets of cables respectively connected to rear edge regions of said first and second printed circuit boards; wherein each set of the first sets of cables is grouped, according to electrical characters thereof, to form a first number of groups, and each set of the second sets of cables is grouped, according to the electrical characters thereof, to form a second number of groups, said first number being different from said second number.

14. The assembly as described in claim 13, wherein each of the first and the second sets of cables is evenly dispersed with each corresponding printed circuit board and essentially at the same lever with the neighboring set.

15. The assembly as described in claim 13, wherein said set of the first sets of cables is of single-ended cables and divided into four groups, while said set of the second sets of cables is of differential pairs cables and divided into five groups.

16. The assembly as described in claim 15, wherein each set of said first sets of cables and second sets of cables are secured in each corresponding set by a cable clamp.

17. The assembly as described in claim 16, wherein said cable clamp used for the first sets of cables and that for the second sets of cables are same with each other.

* * * * *